US010418222B2

(12) United States Patent
Yamada et al.

(10) Patent No.: US 10,418,222 B2
(45) Date of Patent: Sep. 17, 2019

(54) TRANSMISSION TYPE TARGET, RADIATION GENERATING TUBE INCLUDING THE SAME, RADIATION GENERATING APPARATUS, AND RADIOGRAPHY SYSTEM

(71) Applicant: CANON KABUSHIKI KAISHA, Tokyo (JP)

(72) Inventors: Shuji Yamada, Atsugi (JP); Tatsuya Suzuki, Kawasaki (JP); Takeo Tsukamoto, Kawasaki (JP); Yoichi Ikarashi, Fujisawa (JP); Tadayuki Yoshitake, Tokyo (JP); Takao Ogura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1619 days.

(21) Appl. No.: 14/204,810

(22) Filed: Mar. 11, 2014

(65) Prior Publication Data

US 2019/0252150 A1 Aug. 15, 2019

(30) Foreign Application Priority Data

Mar. 12, 2013 (JP) ..... 2013-049350

(51) Int. Cl.
*H01J 35/08* (2006.01)
*H01J 35/18* (2006.01)

(52) U.S. Cl.
CPC ..... *H01J 35/18* (2013.01); *H01J 35/08* (2013.01); *H01J 2235/084* (2013.01); *H01J 2235/087* (2013.01)

(58) Field of Classification Search
CPC ..... H01J 2235/083; H01J 2235/084; H01J 2235/085; H01J 2235/087; H01J 35/08; H01J 35/18
See application file for complete search history.

(56) References Cited

U.S. PATENT DOCUMENTS

| | | | | | |
|---|---|---|---|---|---|
| 4,145,632 | A | * | 3/1979 | Devine, Jr. | H01J 35/108 378/144 |
| 4,392,238 | A | * | 7/1983 | Lersmacher | H01J 35/108 378/144 |
| 4,972,449 | A | * | 11/1990 | Upadhya | H01J 35/108 378/143 |
| 5,148,462 | A | | 9/1992 | Spitsyn | |
| 6,095,966 | A | | 8/2000 | Chornenky | |

(Continued)

FOREIGN PATENT DOCUMENTS

| | | | |
|---|---|---|---|
| CN | 2242521 | Y | 12/1996 |
| CN | 104051206 | B | 5/2016 |
| JP | 2002-298772 | A | 10/2002 |

(Continued)

*Primary Examiner* — Chih-Cheng Kao
(74) *Attorney, Agent, or Firm* — Canon U.S.A. Inc., IP Division

(57) ABSTRACT

A radiation emitting target, a radiation generating device, and a radiography system are provided in which adhesion between a target layer and a diamond substrate is improved and stable radiation emitting properties are exhibited. A transmission type target includes a target layer, a carbon-containing region including sp2 bonds, and a diamond substrate that supports the target layer. The carbon-containing region is positioned between the target layer and the diamond substrate.

4 Claims, 10 Drawing Sheets

(56) References Cited

U.S. PATENT DOCUMENTS

| | | | | |
|---|---|---|---|---|
| 2006/0073640 | A1 | 4/2006 | Hu | |
| 2011/0255664 | A1* | 10/2011 | Ueda | H01J 35/065<br>378/119 |

FOREIGN PATENT DOCUMENTS

| | | | |
|---|---|---|---|
| JP | 2003-505845 | A | 2/2003 |
| JP | 2007305565 | A | 11/2007 |
| JP | 2009-545840 | A | 12/2009 |
| JP | 2012256444 | A | 12/2012 |
| JP | 6100036 | B2 | 3/2017 |
| JP | 6324561 | B2 | 5/2018 |
| WO | 2012140860 | A1 | 10/2012 |
| WO | 2012169141 | A1 | 12/2012 |
| WO | 2013/032015 | A1 | 3/2013 |
| WO | 2013/032020 | A2 | 3/2013 |

* cited by examiner

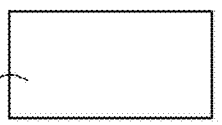
FIG. 6A-1
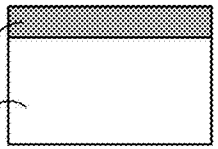
FIG. 6A-2
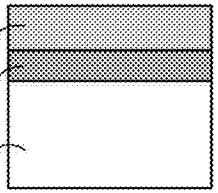
FIG. 6A-3
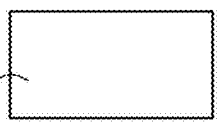
FIG. 6B-1
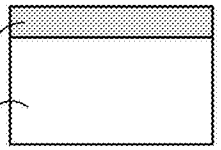
FIG. 6B-2
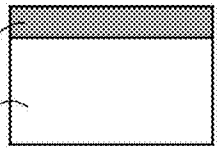
FIG. 6B-3
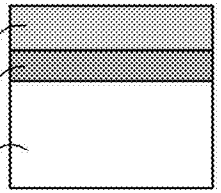
FIG. 6B-4
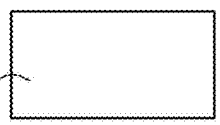
FIG. 6C-1
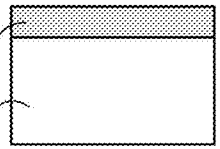
FIG. 6C-2
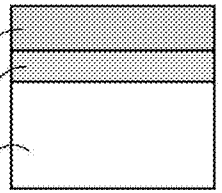
FIG. 6C-3
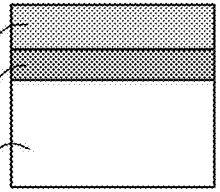
FIG. 6C-4
FIG. 6D-1
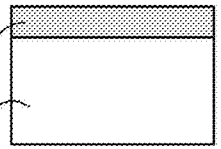
FIG. 6D-2
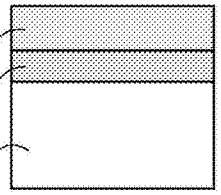
FIG. 6D-3
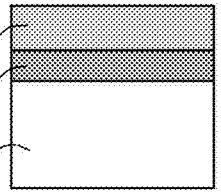
FIG. 6D-4

TRANSMISSION TYPE TARGET, RADIATION GENERATING TUBE INCLUDING THE SAME, RADIATION GENERATING APPARATUS, AND RADIOGRAPHY SYSTEM

BACKGROUND OF THE INVENTION

Field of the Invention

The present invention relates to radiation generating apparatus that are used in medical equipment for diagnosis applications and industrial equipment for non-destructive X-ray imaging, for example.

The present invention particularly relates to a transmission X-ray target that includes a target layer and a diamond substrate supporting the target layer, a radiation generating tube that includes the transmission X-ray target, a radiation generating apparatus that includes the radiation generating tube, and a radiography system that includes the radiation generating apparatus.

Description of the Related Art

Radiation generating apparatus that generate X-rays used in medical diagnosis desirably have enhanced durability and require less maintenance so as to raise the generators' operating rate and serve as medical modality that can be used in home medical care and emergency medicine in the event of disasters and accidents.

One of the main factors that determine the durability of radiation generating apparatus is a heat-resistance of targets used as sources for generating radiation.

In a radiation generating apparatus configured to generate radiation by irradiating a target with an electron beam, the radiation generation efficiency at the target is less than 1% and almost all of the energy applied to the target is converted to heat. If heat generated at the target is not sufficiently released, adhesion of the target may decrease due to thermal stress and the heat-resistance of the target becomes limited.

One known way of improving the radiation generation efficiency of a target is to use a transmission type target that includes a target layer, which is in a form of a thin film that contains a heavy metal, and a substrate that transmits the radiation and supports the target layer. PCT Japanese Translation Patent Publication No. 2009-545840 discloses a rotating anode-type transmission type target offering a radiation generation efficiency at least 1.5 times higher than that of known rotating anode-type reflection targets.

One known way of accelerating the release of heat from the target to outside is to use diamond as a substrate that supports the target layer of a multilayered target. PCT Japanese Translation Patent Publication No. 2003-505845 discloses use of diamond as the substrate that supports a target layer composed of tungsten, by which the heat releasing property is enhanced and microfocusing is realized. Diamond has not only high heat-resistance and high heat conductivity but also a high radiation transmitting property, and is thus suitable as a material for the substrate that supports a transmission type target on one hand.

On the other hand, diamond has low wettability to molten metal and linear expansion coefficient mismatch occurs between diamond and solid metal. Thus, diamond has low affinity to a target metal. Ensuring the adhesion between a target layer and a diamond substrate has been the issue that needs to be addressed in improving the reliability of transmission type targets.

PCT Japanese Translation Patent Publication No. 2003-505845 discloses a transmission type target in which an intermediate layer whose material is not disclosed is provided as an adhesion promoting layer and interposed between a diamond substrate and a target layer.

Japanese Patent Laid-Open No. 2002-298772 discloses that thermal stress occurs between a target layer and a diamond substrate due to linear expansion coefficient mismatch in a radiation generating tube equipped with a transmission type target and that separation and cracks occur in the target layer due to the thermal stress. Japanese Patent Laid-Open No. 2002-298772 discloses a structure in which a target layer is warped toward a diamond substrate so that during operation of a radiation generating tube, the target layer is pressed toward the diamond substrate and separation of the target layer is suppressed thereby.

Even the transmission type targets in which adhesion between a target layer and a diamond substrate is enhanced and which are disclosed in PCT Japanese Translation Patent Publication No. 2003-505845 and Japanese Patent Laid-Open No. 2002-298772 sometimes suffer microcracks in the target layer, resulting in fluctuation in radiation output.

FIGS. 10A and 10B are respectively a plan view and a cross-sectional view of a transmission type target unit 71 that has come to cause fluctuations in radiation output. FIGS. 10A and 10B are obtained by microscopic observation and are provided as a reference example. The transmission type target unit 71 shown in FIGS. 10A and 10B is removed from a radiation generating apparatus not shown in the drawing after a cumulative total of 103 times of exposure. FIG. 10B is a cross-sectional view of the transmission type target unit 71 taken along line XB-XB in the plan view of FIG. 10A.

In the transmission type target unit 71 of the reference example, a microcrack 68 has branches extending at random within a region that corresponds to the irradiation spot of an electron beam not shown in the drawing, and forms a damaged region 67.

More detailed observation of the microcrack 68 within the damaged region 67 revealed that, as shown in FIG. 10B, the microcrack 68 propagates from the upper surface to the lower surface of a target layer 62. As shown in FIG. 10A, in a plane parallel to a target layer 42, a microcrack 68 that has closed loops and island regions 65 and 65' divided by the closed loops of the microcrack 68 are observed. The island regions 65 and 65' are regions where electrical connection to an anode member 49 is not established.

No microcracks 68 were observed in the target layer 62 before the transmission type target unit 71 is assembled into a radiation generating apparatus not shown in the drawings. In the initial stage after the transmission type target unit 71 was assembled into the radiation generating apparatus, no fluctuation in radiation output was observed. Accordingly, generation of the microcrack 68 observed in the target layer 62 and fluctuation in radiation output are presumably caused by driving of the radiation generating apparatus.

In this specification, a "microcrack" refers to a crack that disrupts the continuity of a target layer when observed with a microscope. Such a crack is observed as a local region where higher light scattering is observed if an optical microscope is used, or as a difference in contrast indicating presence of microscopic and discrete voids if a scanning electron microscope such as a scanning electron microscope (SEM), a scanning transmission electron microscope (STEM), or a scanning transmission microscope (STM) is used.

In the observation results shown in FIGS. 10A and 10B, an interlayer is not provided between the target layer 62 and a diamond substrate 61. However, in samples in which a titanium interlayer was formed between the target layer 62 and the diamond substrate 61 also, a similar microcrack 68 and a damaged region 67 that included an island region 65 were sometimes observed.

As described above, the inventors of the present invention have found that as the radiation generating apparatus is driven, microcracks occur in a target layer, performance of the target in maintaining the anode potential at the target layer is degraded, the tube current (anode current) flowing in the target layer 62 becomes unstable, and radiation output from the target layer 62 fluctuates as the driving history of the radiation generating apparatus accumulates.

SUMMARY OF THE INVENTION

The present invention provides a highly reliable transmission type target that has advantages of a transmission type target including a diamond substrate and that suffers less from microcracks in a target layer resulting from operation of a radiation generating tube.

The present invention also provides a highly reliable transmission type target with which an anode potential at the target layer is stabilized and radiation output fluctuations are suppressed. The present invention also provides highly reliable radiation generating tube, radiation generating apparatus, and radiography system with which output fluctuations are suppressed.

An aspect of the invention provides a transmission type target that includes a target layer which is configured to generate an X-ray upon irradiation with electrons and contains a target metal, a carbon-containing region including sp2 bonds, and a diamond substrate configured to support the target layer. The carbon-containing region is positioned between the target layer and the diamond substrate.

Another aspect of the invention provides a method for producing a transmission type target, the method including a target layer formation step of forming a target layer on one surface of a diamond substrate and a sp2 bond formation step of forming a carbon-containing region containing sp2 bonds, the carbon-containing region being in contact with a diamond-substrate-side of the target layer.

Further features of the present invention will become apparent from the following description of exemplary embodiments with reference to the attached drawings.

BRIEF DESCRIPTION OF THE DRAWINGS

FIGS. 6A-1 to 6D-4 show examples of embodiments of methods for producing a transmission type target.

(FIG. 9A: transmission type target, FIG. 9B: reflection target) (FIG. 9C: transmission type target, FIG. 9D: reflection target).

DESCRIPTION OF THE EMBODIMENTS

Preferred embodiments of the present invention will now be described in detail with reference to the attached drawings. The dimensions, materials, shapes, relative positions, and other attributes of the constitutional members described in these embodiments do not limit the scope of the present invention.

Figure 3A:
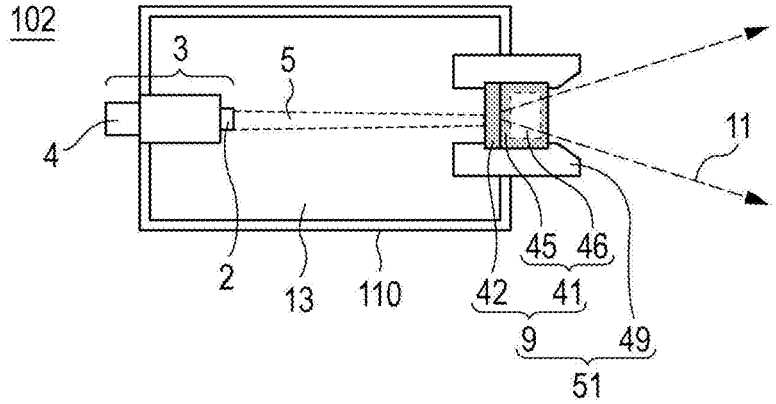
FIG. 3A is a schematic diagram that shows a radiation generating tube equipped with a transmission type target according to an embodiment.
Figure 3B:
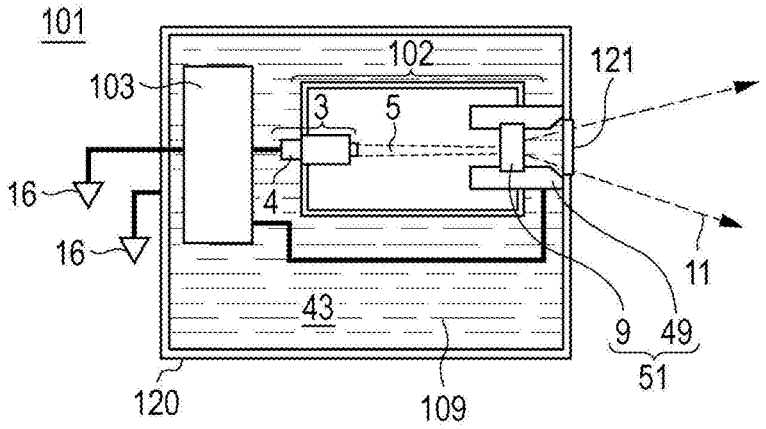
FIG. 3B is a schematic diagram that shows a radiation generating apparatus.

FIG. 3A is a cross-sectional view of an example of a radiation generating tube equipped with a transmission type target according to an embodiment of the invention and FIG. 3B is a cross-sectional view of an example of a radiation generating apparatus.

Radiation Generating Tube

FIG. 3A shows an embodiment of a transmission-type radiation generating tube 102 that includes an electron emitting source 3 and a transmission type target 9 (hereinafter a transmission type target is simply referred to as a "target" in this specification) that faces the electron emitting source 3 with a space therebetween.

In this embodiment, an electron beam 5 emitted from an electron emitting portion 2 of the electron emitting source 3 hits a target layer 42 of the target 9 and a radiation flux 11 is generated as a result.

Electrons in the electron beam 5 are accelerated by an acceleration electric field between the electron emitting source 3 and the target layer 42 up to incident energy needed to generate radiation. The acceleration electric field is generated in an inner space 13 of the radiation generating tube 102 due to a drive circuit 103 that outputs a tube voltage Va and a cathode and an anode electrically connected to the drive circuit 103. In other words, the tube voltage Va output from the drive circuit 103 is applied between the target layer 42 and the electron emitting portion 2.

In this embodiment, as shown in FIG. 3A, the target 9 is constituted by the target layer 42 and a diamond substrate 41 that supports the target layer 42. A target unit 51 at least includes the target 9 and an anode member 49 and functions as an anode of the radiation generating tube 102.

The details of the target 9 and the target unit 51 are described later.

A vacuum atmosphere is created in the inner space 13 of the radiation generating tube 102 in order to guarantee the mean free path of the electron beam 5. The degree of vacuum in the radiation generating tube 102 is preferably $10^{-8}$ Pa or more and $10^{-4}$ Pa or less and, from the viewpoint of the lifetime of the electron emitting source 3, more preferably $10^{-8}$ Pa or more and $10^{-6}$ Pa or less.

The interior of the radiation generating tube 102 can be evacuated by using a vacuum pump not shown in the drawings via an exhaust duct not shown in the drawing and then sealing the exhaust duct. A getter not shown in the drawings may be installed inside the radiation generating tube 102 to maintain the degree of vacuum.

The radiation generating tube 102 includes an insulation tube 110 that serves as a body that electrically insulates between the electron emitting source 3 at a cathode potential and the target layer 42 at an anode potential. The insulation tube 110 is composed of an insulating material such as a glass material or a ceramic material. In this embodiment, the insulation tube 110 defines the distance between the electron emitting source 3 and the target layer 42.

The radiation generating tube 102 may be constituted by an envelope that is airtight and has an atmospheric pressure resisting strength in order to maintain the degree of vacuum. In this embodiment, the envelope is constituted by the insulation tube 110, a cathode equipped with the electron emitting source 3, and an anode equipped with the target unit 51. The electron emitting portion 2 and the target layer 42 are disposed in the inner space 13 or on an inner wall of the envelope.

In this embodiment, the diamond substrate 41 serves as a transmission window for allowing radiation generated at the target layer 42 to go out of the radiation generating tube 102 and also as a part of the envelope.

The electron emitting source 3 is positioned to face the target layer 42 of the target 9. A hot cathode such as a tungsten filament or an impregnated type cathode or a cold cathode such as a carbon nanotube may be used as the electron emitting source 3. The electron emitting source 3 may be equipped with a grid electrode or an electrostatic lens electrode (not shown in the drawings) so as to control the beam diameter and electron current density of the electron beam 5, the ON/OFF timing, and the like. Radiation generating apparatus FIG. 3B shows an embodiment of a radiation generating apparatus 101 that emits a radiation flux 11 from a radiation transmitting window 121. In the radiation generating apparatus 101 of this embodiment, the radiation generating tube 102 that serves as a radiation source and a drive circuit 103 configured to drive the radiation generating tube 102 are housed in a container 120 that has the radiation transmitting window 121.

A tube voltage Va is applied between the target layer 42 and the electron emitting portion 2 from the drive circuit 103 illustrated in FIG. 3B. An appropriate tube voltage Va may be selected in accordance with the thickness of the target layer 42 and the metal type of the target so as to form a radiation generating apparatus 101 that generates a desired type of line.

The container 120 housing the radiation generating tube 102 and the drive circuit 103 desirably has a sufficient strength as a housing and a good heat releasing property. For example, the container 120 may be composed of a metal material such as brass, iron, or stainless steel.

In this embodiment, an insulating liquid 109 fills an extra space 43 inside the container 120 and surrounding the radiation generating tube 102 and the drive circuit 103. The insulating liquid 109 has an electrical insulating property, maintains the electrical insulation inside the container 120, and serves as a cooling medium for the radiation generating tube 102. An electrically insulating oil such as a mineral oil, a silicone oil, or a perfluoro-based oil may be used as the insulating liquid 109.

Radiography System

Next, an example of a radiography system 60 equipped with a target according to an embodiment of the invention is described with reference to FIG. 3C.

A system control unit 202 is configured to integrally control the radiation generating apparatus 101 and a radiation detector 206. The drive circuit 103 under control of the system control unit 202 outputs various control signals to the radiation generating tube 102. Although the drive circuit 103 is housed in the container 120 of the radiation generating apparatus 101 together with the radiation generating tube 102 in this embodiment, the drive circuit 103 may alternately be disposed outside the container 120. In response to the control signals output from the drive circuit 103, the state of emission of the radiation flux 11 emitted from the radiation generating apparatus 101 is controlled.

The radiation flux 11 emitted from the radiation generating apparatus 101 has its irradiation range adjusted by a collimator unit (not shown) equipped with a movable aperture, is emitted outside the radiation generating apparatus 101, passes through a specimen 204, and detected with the radiation detector 206. The radiation detector 206 converts the detected radiation into an image signal and outputs the image signal to a signal processor 205.

The signal processor 205 processes the image signal under control of the system control unit 202 and outputs the processed image signal to the system control unit 202.

Based on the processed image signal, the system control unit 202 outputs to a display device 203 a display signal for displaying an image in the display device 203.

The display device 203 displays the image based on the display signal so as to show a captured image of the test object 204.

A representative example of the radiation discussed in this specification is an X-ray. The radiation generating apparatus 101 and the radiography system according to embodiments of the invention can be used as an X-ray generating unit and an X-ray imaging system. X-ray imaging systems can be used in non-destructive inspection of industrial products and medical diagnosis of human and animals.

Target

Next, a structure and operation state of a basic embodiment of a target of the invention are described with reference to FIGS. 1A and 1B.

Figure 1A:
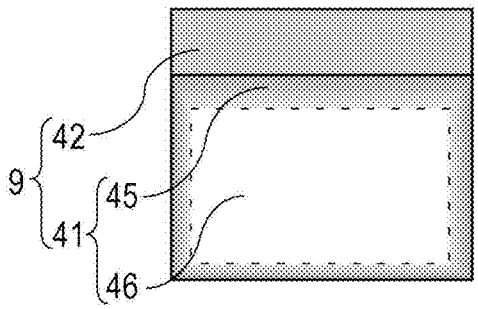
FIG. 1A is a schematic cross-sectional view of a basic structural example of a transmission type target according to an embodiment and FIG. 1B is a schematic cross-sectional view of the transmission type target in an operating state.

According to an embodiment shown in FIG. 1A, a target 9 at least includes a target layer 42 containing a target metal and a diamond substrate 41 that supports the target layer 42. The diamond substrate 41 has a region 46 constituted by sp3 bonds. The target layer 42 has a diamond-substrate-41-side portion connected to a carbon-containing region 45 having sp2 bonds. In this specification, the target 9 illustrated in FIG. 1A is a first embodiment of the invention.

Figure 1B:
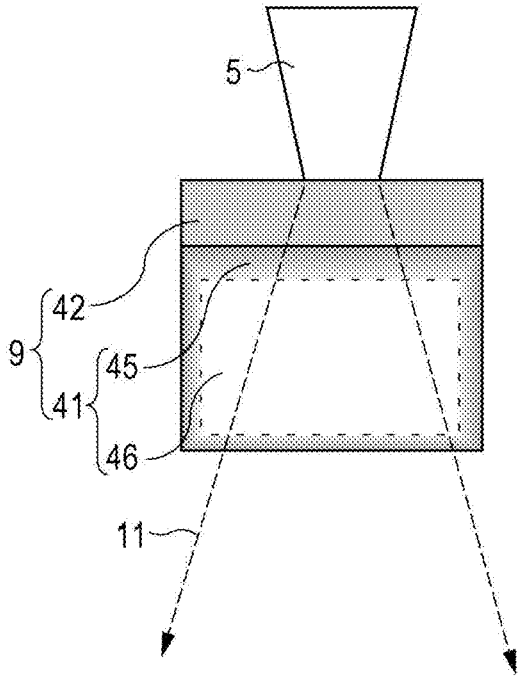

FIG. 1B shows an operation state of the target 9 illustrated in FIG. 1A. One of the surfaces of the target layer 42 is irradiated with an electron beam 5 and thus radiation is emitted in a radial manner. The target 9 is a transmission type target with which some of components are selected with a collimator or the like (not shown in the drawing) from the components of the radiation emitted from the target layer 42 and passed through the diamond substrate 41 in the substrate thickness direction, and output as the radiation flux 11.

Either natural diamond or a synthetic diamond prepared by chemical vapor deposition (CVD), a high-temperature high-pressure synthetic process, or the like can be used as the diamond substrate 41. From the viewpoint of controlling the operation properties of the target, synthetic diamond having uniform physical property values such as heat-resistance, heat conductivity, and the like is favored. In particular, from the viewpoint of heat-resistance, synthetic diamond prepared by a high-temperature high-pressure synthetic process is favored.

The thickness of the diamond substrate 41 is 0.1 mm to 10 mm so that both heat conductivity and a radiation transmission property in the substrate thickness direction can be achieved. The diamond substrate 41 may be composed of single crystal diamond or polycrystal diamond. From the viewpoint of heat conductivity, single crystal diamond is preferred. The diamond substrate 41 may contain 2 ppm to 800 ppm of nitrogen since impact resistance is improved and thus the portability of a radiation generating apparatus to which the target 9 can be applied can be improved.

The target layer 42 contains a metal element having a large atomic number, a high melting point, and a high specific gravity as a target metal. From the viewpoint of affinity to the diamond substrate 41, the target metal may be at least one metal selected from the group consisting of tantalum, molybdenum, and tungsten whose carbides exhibit negative standard free energy of formation. The target metal may be a single metal or an alloy, or a metal compound such as a carbide, nitride, or oxynitride of the metal.

The thickness of the target layer 42 is within the range of 1 μm or more and 20 μm or less. The lower limit and upper limit of the range of the thickness of the target layer 42 are determined from the viewpoints of ensuring radiation output intensity and decreasing interfacial stress. The thickness of the target layer 42 may be in the range of 1.5 μm or more and 12 μm or less.

The thickness of the carbon-containing region 45 will now be described. The thickness of the carbon-containing region 45 in the thickness direction of the target layer 42 may be 0.005 times to 0.1 times the thickness of the target layer 42. The lower limit of the thickness of the carbon-containing region 45 is determined based on the carbon's stress relaxing effect and is more preferably 50 nm or more. The upper limit of the thickness of the carbon-containing region 45 is determined from the viewpoint of heat-resistance of the target 9 and is more preferably 500 nm or less.

In this embodiment, the carbon-containing region 45 is a region of the diamond substrate 41 near the surfaces of the diamond substrate 41. In this region, thermal structural changes occurred so that sp3 bonds are converted into sp2 bonds. In other words, in this embodiment, the carbon-containing region 45 is part of the diamond substrate 41.

In this specification, the carbon-containing region 45 refers to a region where carbon atoms are bonded to one another through sp2 hybrid orbitals resulting from σ bonds and π bonds and where carbon-carbon double bonds are present. Accordingly, so-called one-and-a-half bonds found in π electron conjugated system and aromatic carbon compounds indicate the state in which 50% of the bonds are double bonds.

Diamond solely constituted by sp3 bonds has high elastic modulus, high hardness, and high thermal conductivity due to its covalently bonded cubic structure. In contrast, graphite, which is an allotrope of diamond, has a layered hexagonal structure and carbon-carbon bonds in each layer form sp2 hybrid orbitals. Within each layer of graphite, carbon atoms are covalently bonded and the bonding strength of between carbon atoms is relatively high. However, layers are bonded to each other through Van Der Waals force and thus bonding strength between carbon atoms of adjacent layers is relatively weak.

Due to such a difference in structure, the Young's modulus of diamond and the Young's modulus of graphite are 1000 GPa and 10 GPa, respectively, and differ from each other by two orders of magnitude. Accordingly, it is possible to decrease the Young's modulus of a portion of the diamond substrate 41 for a control width of several to several hundred GPa by controlling the percentage of sp3 bonds to be converted into sp2 bonds in the diamond substrate 41.

The linear expansion coefficient can also be increased by several times from about $1\times10^{-6\circ}$ C.$^{-1}$ of diamond to about $6\times10^{-6\circ}$ C.$^{-1}$ of graphite when the percentage of the sp3 bonds of the diamond substrate 41 to be converted to sp2 bonds is controlled. As a result, the carbon-containing region 45 exhibits a linear expansion coefficient close to the target metal (for example, $4.5\times10^{-6\circ}$ C.$^{-1}$ of tungsten) than the region 46 constituted by sp3 bonds.

Accordingly, the carbon-containing region 45 in this embodiment can be regarded as a stress relaxing region against thermal stress and also as a matching region that reduces the mismatch of linear expansion coefficient.

Next, the relationship between the issue the invention is directed to and the structure of the target layer is described in detail with reference to FIGS. 9A to 9D. The "degradation of performance of a target in maintaining the anode potential at the target layer" is strongly correlated with the layer structure of the target.

Figure 9A:
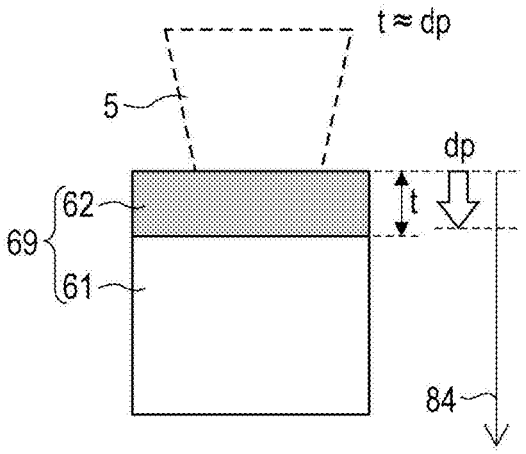
FIGS. 9A and 9B are schematic cross-sectional views showing the relationship between an electron penetration length and a target layer thickness
Figure 9B:
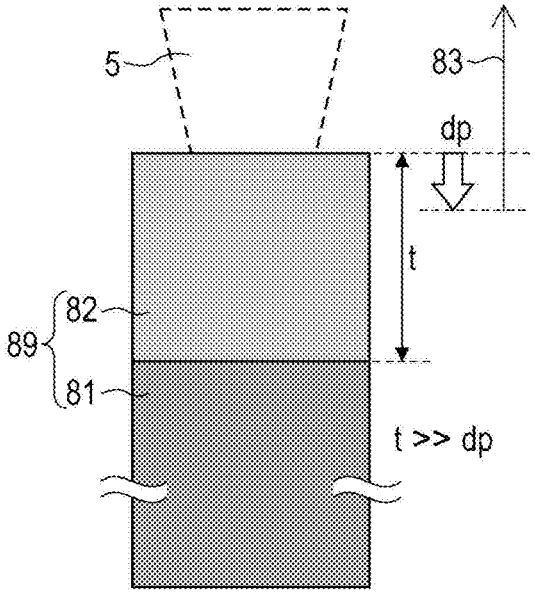
Figure 9C:
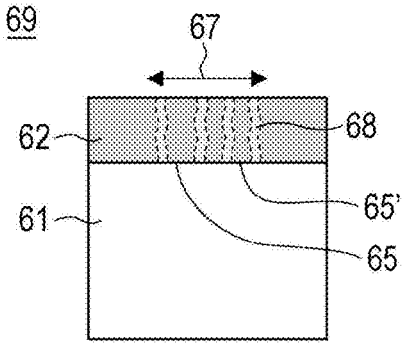
FIGS. 9C and 9D are schematic cross-sectional views showing the relationship between a depth of a microcrack and a target layer thickness
Figure 9D:
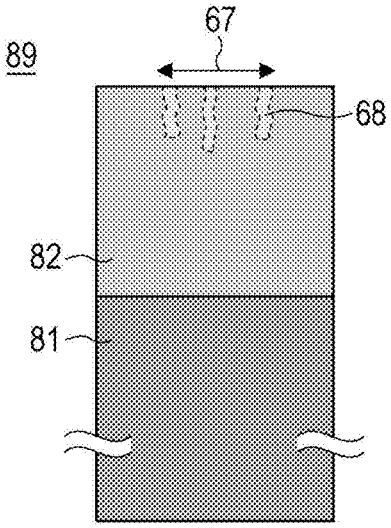

FIGS. 9A and 9B are respectively a schematic diagram of a typical cross-sectional layer structure of a transmission type target 69 and a schematic diagram of a typical cross-sectional layer structure of a reflection target 89. FIGS. 9C and 9D respectively show a distribution of microcracks 68 in the transmission type target 69 and a distribution of microcracks 68 in the reflection target 89.

As shown in FIG. 9B, in the reflection target 89 that includes a target layer 82 and a substrate 81, radiation generated at the electron penetration depth dp is not output from the opposite side of the target layer 82 and is output in a rear direction 83 from the surface on which the electron beam 5 is incident. Accordingly, the thickness t of the target layer 82 of the reflection target 89 can be set to a sufficiently large value relative to the electron penetration depth dp without considering the radiation transmittance in the layer thickness direction.

To be more specific, the electron penetration depth dp, which is dependent on tube voltage, is typically within the range of several micrometers to less than 20 micrometers. The thickness t of the target layer 82 is typically within the range of several millimeters to less than 20 millimeters due to thermal capacity design and strength design requirements, etc. The thickness of a heat-generating portion of the target layer 82 substantially coincides with the electron penetration depth dp of the electron beam 5 relative to the target layer 82. Accordingly, the thickness of the heat-generating portion of the reflection target 89 is sufficiently small relative to the thickness t of the target layer 82.

Accordingly, the thermal stress generated in the reflection target 89 is concentrated near the surface layer of the target layer 82. The possibility that a microcrack 68 would penetrate entirely through the target layer 82 in the thickness direction is low. Furthermore, due to design flexibility of the reflection target 89, a supporting member having electrical conductivity such as copper can be disposed on the rear surface of the target layer 82. Accordingly, degradation of the performance of the target in maintaining the anode potential at the target layer 82 rarely occurs in the reflection target 89.

In contrast, as shown in FIG. 9A, radiation generated at an electron penetration depth dp in the target layer 62 of the transmission type target 69 passes through the target layer 62 and the diamond substrate 61 and is output in a front direction 84. Accordingly, the thickness t of the target layer 62 of the transmission type target 69 is set to a thickness substantially equal to the electron penetration depth dp (0.5×dp or more and 1.5×dp or less) while taking into consideration attenuation in the target layer 62.

Accordingly, thermal stress generated in the transmission type target 69 is distributed over the entire thickness t of the target layer 82. Thus, as shown in FIG. 9C, a microcrack 68 that penetrates entirely through the layer of the target layer 82 in the thickness direction may occur. In such a case, unlike in the case of the reflection target 89, the performance of the target in maintaining the anode potential at the target layer 62 is degraded due to the microcrack 68 since it is difficult to supply the anode potential from the rear side of the target layer 62.

As discussed above, the phenomenon of "degradation of performance of the target in maintaining the anode potential at the target layer" due to occurrence of the microcrack 68 is an issue that is deeply related to the structure of a transmission type target.

Next, thoughts of the inventors regarding the mechanism by which a microcrack 68 propagates inside the target layer 62 and comes to cause formation of island regions 65 and 65' are discussed.

A first factor responsible for generation of a microcrack 68 in the target layer 62 is thermal stress. Thermal stress is defined by mismatch in linear expansion coefficient between the target layer 62 and the diamond substrate 61 ($\Delta\alpha=\alpha 62-\alpha 61$, 5 to $9\times10^{-6}$° C.$^{-1}$) and the temperature increase (650° C. to 1400° C.) during operation of the transmission type target.

The thermal stress has a vector in a direction parallel to the layer surface of the target layer 62 and serves as a driving force responsible for causing separation of and generating cracks in the target layer. This is qualitatively disclosed in Japanese Patent Laid-Open No. 2002-298772.

A second factor responsible for generation of the microcrack 68 in the target layer 62 is that the diamond substrate 61 has a high elastic modulus.

Diamond has a particularly high elastic modulus (1050 GPa at room temperature (25° C.)) due to its unique crystal structure. The elastic modulus of a high-melting-point metal element selected as the target metal is not as high as that of diamond. Thus, thermal stress in the target tends to be concentrated in the target layer 62.

The elastic modulus (Young's modulus) of representative examples of metal elements that can be used as the target metal is 403 for tungsten, 327 for molybdenum, and 181 for tantalum in terms of GPa at room temperature, 25° C.

A third factor responsible for generation of a microcrack 68 in the target layer 62 is that the target layer 62 has a polycrystal structure.

A gas-phase deposition process (dry film-forming process) such as sputtering, vapor deposition, or chemical vapor deposition (CVD) is generally employed to form the target layer 62. A target layer 62 formed by a gas-phase deposition process frequently takes a columnar structure with columnar crystal grains extending in the layer thickness direction. Crystal grain boundaries contained in the columnar structure intersect the direction in which thermal stress acts. Accordingly, the crystal grains contained in the columnar structure are a factor that limits the mechanical stress of a shear failure mode of the target layer 62.

A fourth factor responsible for generation of the microcrack 68 in the target layer 62 is that the crystal grains constituting the target layer 62 become more coarse as they undergo an increase in temperature.

Figure 8A:
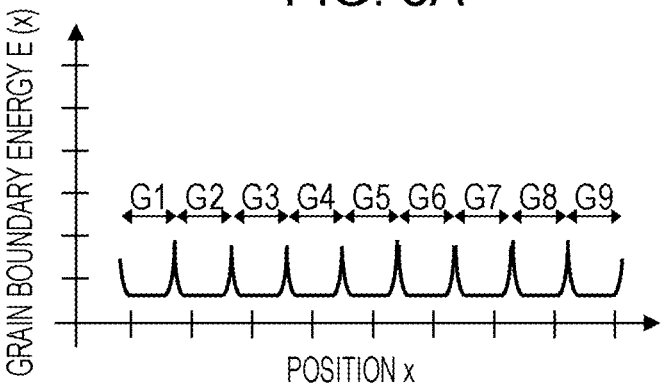
FIGS. 8A to 8C are conceptual renderings of grain boundary energy distribution and grain diameters in a target layer at the initial stage (8A), the intermediate stage (8B), and the later stage (8C).

FIG. 8A is a conceptual rendering of a grain boundary energy distribution of a polycrystal structure constituting a target layer immediately after completion of deposition. The vertical axis indicates grain boundary energy per unit grain boundary area and the horizontal axis indicates the positions of crystal grains G1 to G9 in the polycrystal structure of the target layer.

The positions of ten peaks found in this grain boundary energy distribution correspond to crystal grain boundaries and the peak-to-peak distance Δx of the energy distribution indicates a crystal grain diameter of each of the crystal grains G1 to G9. At this initial stage, no significant variation is observed in terms of crystal grain diameter and grain boundary energy and no microcracks are present in the target layer.

Figure 8B:
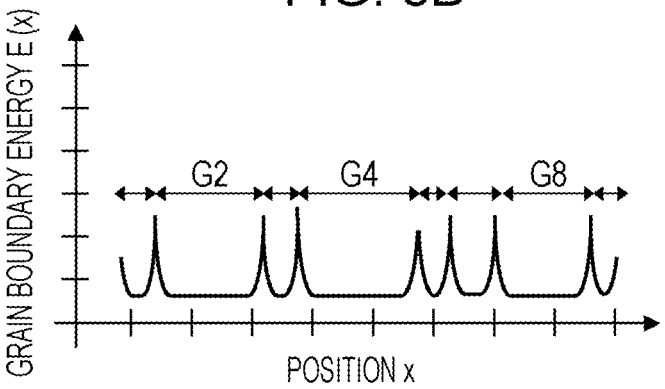

FIG. 8B is a conceptual rendering of a grain boundary energy distribution of the target layer that underwent heat history accompanying radiation generating operation. The distribution corresponds to crystal grains G1 to G4 and G6 to G9. FIG. 8B shows that both crystal grains that are growing and crystal grains that are shrinking are present at this intermediate stage. The crystal grain G5 which was present in the target layer in the initial stage merges into the crystal grain G4 that is growing, and disappears. The grain boundary energy at the grain boundary defined by a growing crystal grain whose grain diameter is increasing is high compared to the initial stage. At this stage, no microcracks are found in the target layer.

Figure 8C:
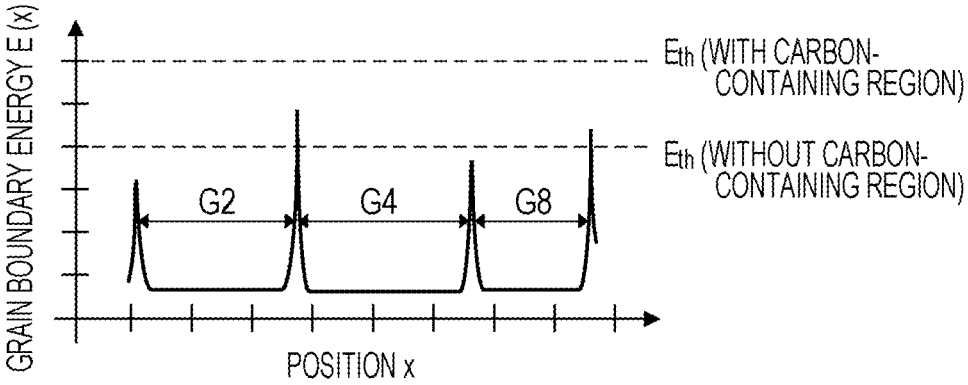

FIG. 8C is a conceptual rendering of the grain boundary energy distribution corresponding to the crystal grains G2, G4, and G8 that have become more coarse as a result of merging with adjacent crystal grains. FIG. 8C shows that selective coarsening of crystal grains and the increase in grain boundary energy are more notable in this later stage than in the intermediate stage. The increase in grain boundary energy is presumably caused by grains taking in the energy of dislocations, microdefects, etc., at grain boundaries of fine crystal grains that have been merged and disappeared.

Presumably, a microcrack occurs and the grain boundary energy is released as the grain boundary energy is increased and comes to exceed the upper limit $E_{th}$ up to which a continuous film structure can be maintained.

As discussed above, the mechanism of radiation output fluctuation observed in the aforementioned study results have all of the first to fourth factors correlated to one another although the detailed mechanism is not clear. It is presumed that because of this mechanism, a microcrack 68 that extends in the in-plane direction and the thickness direction of the target layer 62 occurred as shown by the transmission type target unit 71 in FIGS. 10A and 10B.

The stress relaxing effect exhibited by the carbon-containing region of this embodiment presumably suppresses generation of a microcrack in the target layer that has undergone heat history because the carbon-containing region apparently increases the upper limit $E_{th}$ of the grain boundary energy as shown in FIG. 8C.

The carbon-containing region not only has a stress relaxing effect but also has electrical conductivity attributable to the π electron conjugated system since a particular concentration of sp2 bonds are contained. Thus, the carbon-containing region also has an effect of ensuring the electrical connection to the target layer. Note that from the viewpoint of the electrical conductivity attributable to the π electron conjugated system, 20% or more of the carbon-carbon bonds are preferably sp2 bonds and more preferably 40% or more of the carbon-carbon bonds are sp2 bonds.

Figure 10A:
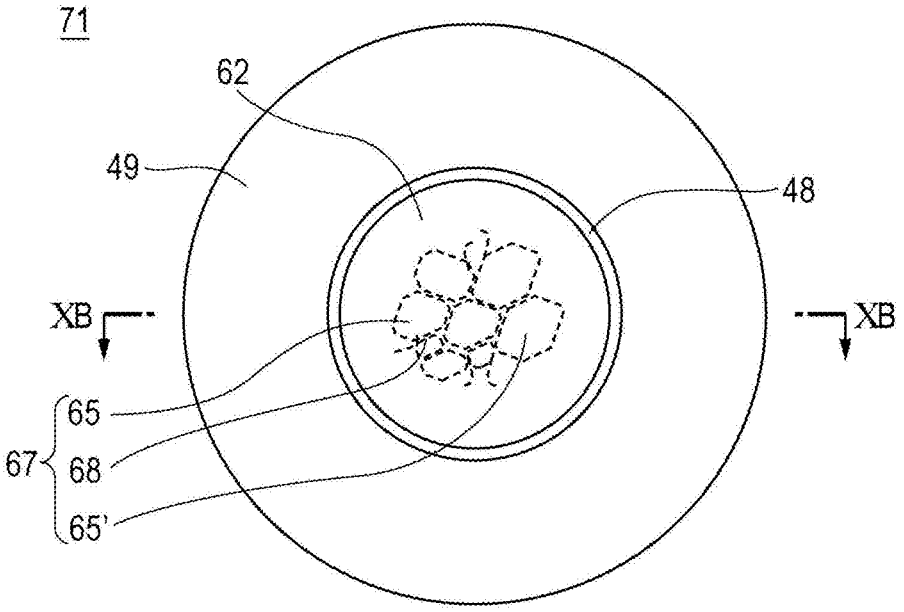
FIGS. 10A and 10B are a plan view and a cross-sectional view, respectively, of a transmission type target in which microcracks occurred in a target layer.
Figure 10B:
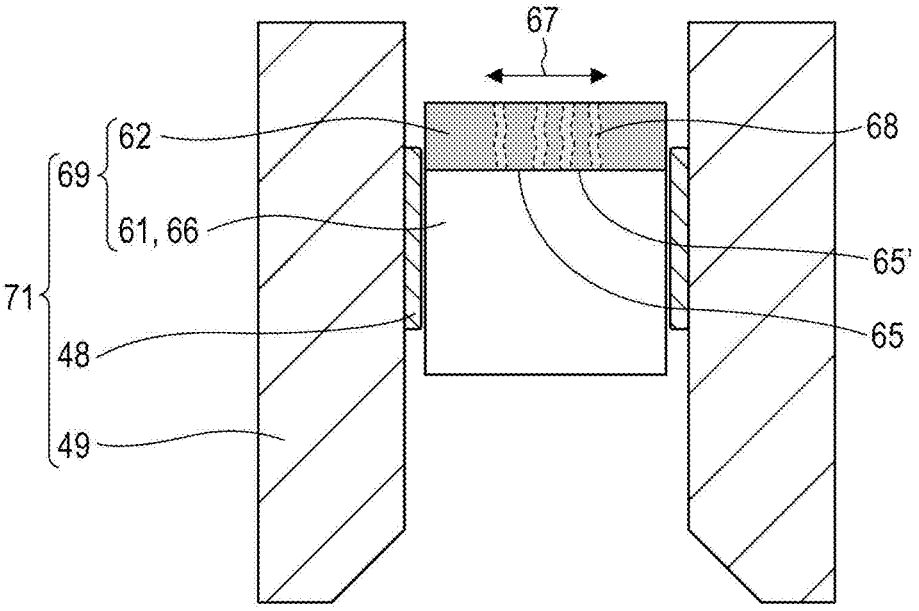

Since the carbon-containing region 45 has electrical conductivity, the electrical connection between the island region 65 and the anode member 49 can be ensured in the layer surface direction in the event of occurrence of a microcrack 68 in the target layer 62 shown in FIGS. 10A and 10B.

Since the diamond substrate 41-side of the target layer 42 has a portion that is connected to the carbon-containing region 45 containing sp2 bonds, a target 9 in which the target layer 42 is stably maintained at the anode potential can be offered. In other words, since the carbon-containing region 45 is positioned between the target layer 42 and the region 46 of the diamond substrate 41, a target 9 in which the target layer 42 is stably maintained at the anode potential can be offered.

The material constituting the carbon-containing region 45 may be a carbon compound that has sp2 bonds in a cyclic main chain, a linear main chain, or a three-dimensional network main chain or a diamond allotrope having sp2 bonds.

Typical materials used as the allotrope of diamond are graphite, graphene, and glassy carbon solely constituted by sp2 bonds. These materials can be used to form the carbon-containing region 45. However, the material for the carbon-containing region 45 need not be solely formed of sp2 bonds.

Examples of the material for the carbon-containing region 45 include amorphous carbon having dangling bonds, carbon nanotubes mainly constituted by six-membered rings, and fullerene constituted by five-membered rings and six-membered rings. Other examples of the material constituting the carbon-containing region 45 include graphite nanofibers in which fibrous graphene sheets are stacked and diamond-like carbon having three dimensional carbon-carbon atomic network containing sp3 bonds and sp2 bonds.

The carbon compound used as the material for the carbon-containing region 45 may be a hydrocarbon compound having functional groups introduced into an allotrope of diamond, a polymer complex having coordinate bonds with a particular metal ion, or an electrically conductive polymer having π electron conjugated system developed on a main chain as long as sp2 bonds are in the main chain.

Next, a basic production method of the first embodiment for producing the target 9 shown in FIG. 1A is described with reference to FIGS. 5A-1 to 5A-3.

The production method of the first embodiment includes the following steps.

Figures 1, 5A:
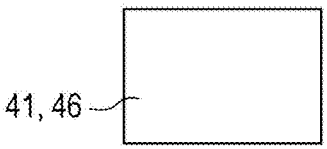
FIGS. 5A-1 to 5E-3 show examples of embodiments of methods for producing a transmission type target.

First, as shown in FIG. 5A-1, a diamond substrate 41 is prepared. The diamond substrate 41 is a polyhedron. Next, as shown in FIG. 5A-2, the diamond substrate 41 is heat-treated in a deoxidizing atmosphere to convert part of the diamond substrate 41 into graphite or the like. In other words, in the heating step of this embodiment, some of sp3 bonds contained in the diamond substrate 41 are structurally changed by applying heat and converted into sp2 bonds.

Figures 1, 5B:
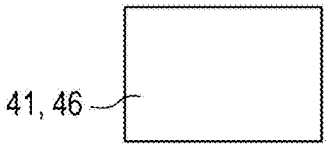
Figures 1, 5C:
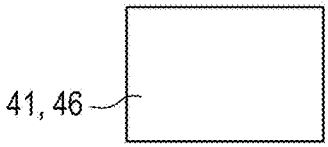
Figures 2, 5A:
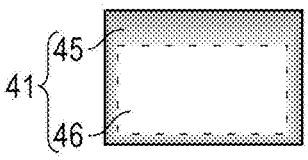
Figures 2, 5B:
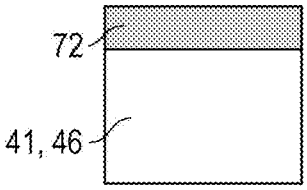
Figures 3, 5A:
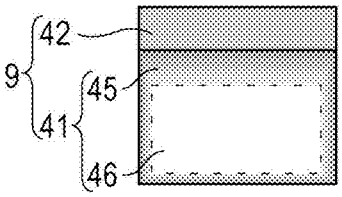
Figures 3, 5B:
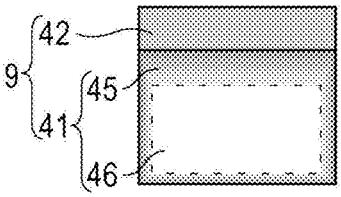
Figures 2, 5C:
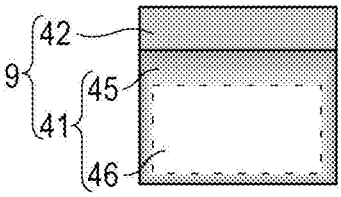

Next, as shown in FIG. 5A-3, a target layer 42 containing a target metal is formed on the diamond substrate 41 having a carbon-containing region 45 so as to form a target 9.

The deoxidizing atmosphere employed in this embodiment has a technical significance of suppressing a volume decrease and loss of the diamond substrate 41 resulting from combustion of the diamond substrate 41. The deoxidizing atmosphere in the heating step is created by filling the interior of a process chamber with an inert gas such as nitrogen or rare gas or by purging oxygen from the process chamber through evacuation. The heating step may be performed in a vacuum atmosphere or an inert gas atmosphere.

The heating step in this embodiment may be performed at a temperature in the range of 650° C. or more and 2000° C. or less from the viewpoints of process time and retention of strength of the diamond substrate. The heating step may be performed while bringing the diamond substrate 41 in contact with a metal stage having high heat conductivity or while thermally insulating and supporting the diamond substrate 41 with a jig composed of a porous ceramic having low heat conductivity.

The carbon-containing region 45 may be distributed over the entire diamond substrate 41 but is preferably at least present at high concentration at the surface on which the target layer 42 is to be formed.

The inventors have conducted investigations and found that a carbon-containing region 45 is preferentially formed at the surfaces of the diamond substrate 41 as shown in FIG. 5A-2 even when the diamond substrate 41 is uniformly heated in a deoxidizing atmosphere. This is presumably because the number of defects is larger at the surfaces of the diamond substrate 41 than in the inner side of the substrate and thus sp3 bonds in the surface-side portions are preferentially converted into sp2 bonds compared to the inner side.

Modification examples of the production method of the first embodiment will now be described with reference to FIGS. 5B-1 to 5B-3 and FIGS. 5C-1 and 5C-2.

The production method illustrated in FIGS. 5B-1 to 5B-3 differs from the production method illustrated in FIGS. 5A-1 to 5A-3 in that a metal-containing layer forming step (FIG. 5B-2) of forming a metal-containing layer 72 containing a target metal on the diamond substrate 41 is performed before the heating step (FIG. 5A-3). This production method has two advantages over the production method shown in FIGS. 5A-1 to 5A-3.

The first advantage is that the metal-containing layer 72 has a larger absorbance index in an infrared wavelength region than the diamond substrate 41 and heat conductivity lower than that of the diamond substrate. Accordingly, the metal-containing layer 72 is selectively heated during the heat treatment. As shown in FIG. 5B-3, the carbon-containing region 45 is preferentially formed at the target layer 42-side surface of the diamond substrate 41 compared to the interior and other surfaces of the diamond substrate 41. As a result, the quantity of heat needed to form the carbon-containing region 45 can be decreased, contributing to energy conservation.

The second advantage is that the metal material constituting the metal-containing layer 72 is supplied with carbon as carbon atoms contained in the diamond substrate 41 diffuse during the heating step shown in FIG. 5B-3. The carbon atoms contained in the diamond substrate 41 diffuse into the metal-containing layer 72 since there is a carbon concentration gradient from the diamond substrate 41 toward the metal-containing layer 72. Diffusion of the carbon atoms into the metal-containing layer 72 continues until a concentration gradient in a thermal equilibrium state is reached.

During the elementary process of carbon diffusion, sp3 bonds constituting the diamond substrate 41 and being present at the surface in contact with the metal-containing layer 72 are unbonded and carbon atoms are supplied to the metal-containing layer 72. Since the diamond substrate 41 supplies carbon atoms to the metal-containing layer 72, the dangling bonds generated by consumption of carbon atoms form sp2 bonds.

The production method illustrated in FIG. 5C-1 and 5C-2 differs from the production method illustrated in FIGS. 5A-1 to 5A-3 in that the diamond substrate 41 is subjected to a heating step while performing the step of forming a metal-containing target layer 42 on the diamond substrate 41. In this embodiment also, it is possible to preferentially form the carbon-containing region 45 at the target layer 42-side of the diamond substrate 41. This production process has the first and second advantages described above over the production method illustrated in FIGS. 5A-1 to 5A-3 and also a third advantage of requiring fewer steps.

Modification examples of the target of the first embodiment will now be described with reference to FIGS. 4B and 4C.

Figure 4A:
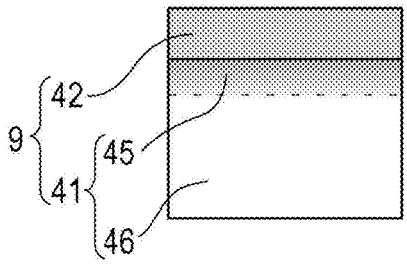
FIGS. 4A to 4E show other structural examples of the transmission type targets.
Figure 4B:
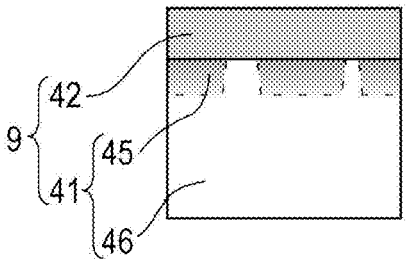

The modification example shown in FIG. 4B differs from the first embodiment in that the carbon-containing region 45 is discretely formed between the target layer 42 and the region 46 constituted by sp3 bonds. The carbon-containing region 45 may be a continuous layer or a discontinuous layer or may be even dispersed in the diamond substrate 41 without forming a particular layer as long as sp2 bonds are contained in the target layer 42-side portion of the substrate.

The target 9 shown in FIG. 4B can be formed by irradiating the metal-containing layer 72 with an infrared laser beam in the steps shown in FIGS. 5B-2 and 5B-3, for example.

Figure 4C:
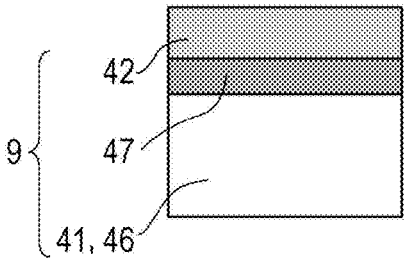

In the modification example illustrated in FIG. 4C, a carbon-containing region is formed as a carbon-containing layer 47 between the target layer 42 and the diamond substrate 41. In this modification example also, the carbon-containing layer 47 may be a continuous layer or a discontinuous layer as long as sp2 bonds are contained on the target layer 42-side. In this specification, the modification example illustrated in FIG. 4C is referred to as a target of a second embodiment.

An example of a method for producing the target 9 according to the second embodiment illustrated in FIG. 4C is illustrated in FIGS. 6A-1 to 6A-3.

First, as shown in FIG. 6A-1, a polyhedral diamond substrate 41 is prepared. Then as shown in FIG. 6A-2, a carbon-containing layer 47 containing sp2 bonds such as graphite or glassy carbon is formed on one surface of the diamond substrate 41. Then as shown in FIG. 6A-3, a target layer 42 is formed on the carbon-containing layer 47. Thus, a target 9 of the second embodiment having the carbon-containing layer 47 as an intermediate layer can be produced.

Next, a first modification example of the method for producing the target 9 according to the second embodiment is described with reference to FIGS. 6B-1 to 6B-4.

The production method of the first modification example differs from the production method illustrated in FIG. 6A-1 to 6A-3 in that a carbon-containing film 77 which may contain sp2 bonds or no sp2 bonds is formed and used as a starting material, and a heat treatment is performed to increase the concentration of the sp2 bonds so as to form a carbon-containing layer 47.

In particular, first, as illustrated in FIG. 6B-1, a polyhedral diamond substrate 41 is prepared. Then in a step shown in FIG. 6B-2, a carbon-containing film 77 is formed on the diamond substrate 41. In a step shown in FIG. 6B-3, at least the carbon-containing film 77 is subjected to a heat treatment. Then in a step shown in FIG. 6B-4, a target layer 42 is formed on the carbon-containing layer 47. As a result, a target 9 of the second embodiment that includes the carbon-containing layer 47 as an intermediate layer is obtained.

A second modification example of the method for producing the target 9 of the second embodiment will now be described with reference to FIGS. 6C-1 to 6C-4.

The production method of the second modification example differs from the production method illustrated in FIGS. 6B-1 to 6B-4 in that a step of converting a carbon-containing film 77 into a carbon-containing layer 47 illustrated in FIG. 6C-4 is performed after a step of forming a target layer 42 on the carbon-containing film 77 illustrated in FIG. 6C-3.

A third modification example of the method for producing the target 9 of the second embodiment will now be described with reference to FIGS. 6D-1 to 6D-4.

The production method of the third modification example differs from the production method illustrated in FIGS. 6C-1 to 6C-4 in that a metal-containing layer 72 containing a target metal is formed as shown in FIG. 6D-3 and then a step of converting a carbon-containing film 77 into a carbon-containing layer 47 by a heat treatment and a step of converting the metal-containing layer 72 into a target layer 42 are performed simultaneously as shown in FIG. 6D-4.

The basic method for producing the target 9 of the second embodiment illustrated in FIGS. 8A-1 to 6A-3 is advantageous over the first to third modification examples in that the method involves fewer steps. The second and third modification examples are advantageous over the basic method and the first modification example in that the second and third advantages described above are achieved because the carbon-containing layer 47 containing sp2 bonds is formed by a heat treatment after formation of the target layer 42 or the metal-containing layer 72.

The target of the second embodiment is disadvantageous in terms of production compared to the target of the first embodiment in that a step of forming an independent intermediate layer is necessary. However, the target of the second embodiment is advantageous in terms of production compared to the target of the first embodiment in that there is no need to perform a high-temperature treatment in a deoxidizing atmosphere needed to convert the diamond substrate 41. Whether to choose the first embodiment or the second embodiment can be appropriately determined by considering the consistency with other production steps.

As shown in FIGS. 5A-1 to 5E-3 and FIGS. 6A-1 to 6D-4, in both the first embodiment and the second embodiment, the target production method includes a target layer formation step of forming a target layer 42 on one surface of a diamond substrate 41. The target production method also includes a sp2 bond formation step of forming a carbon-containing region 45 having sp2 bonds and being in contact with a diamond substrate 41-side of the target layer 42.

As shown in FIGS. 5A-1 to 5E-3, the target layer formation step of the target production method of the first embodiment includes a step of forming a metal layer (the target layer 42 or metal-containing layer 72) containing a target metal on one surface of a diamond substrate 41. The steps illustrated in FIGS. 5A-3, 5B-2, 5C-2, 5D-2, and 5E-3 each correspond to the step of forming a metal layer (the target layer 42 or metal-containing layer 72).

Moreover, as shown in FIGS. 5A-1 to 5E-3, the sp2 bond formation step of the target production method of the first embodiment includes a heating step of heating the diamond substrate and converting at least some of sp3 bonds contained in the surface of the diamond substrate into sp2 bonds. The steps illustrated in FIGS. 5A-2, 5B-3, 5C-2, 5D-3, and 5E-2 each correspond to the heating step.

As shown in FIGS. 6A-1 to 6A-3, the sp2 bond formation step of the target production method of the second embodiment includes forming a carbon-containing layer 47 containing sp2 bonds on one surface of the diamond substrate 41. The step of forming the carbon-containing layer 47 containing sp2 bonds corresponds to the step illustrated in FIG. 6A-2.

As shown in FIGS. 6B-1 to 6D-4, the sp2 bond formation step of the target production method of the second embodiment includes a step of forming a carbon-containing film 77 having sp3 bonds on one surface of a diamond substrate 41 and a step of heating at least the carbon-containing film 77 so as to convert the carbon-containing film 77 into a carbon-containing layer 47 having sp2 bonds.

Steps illustrated in FIGS. 6B-1, 6C-2, and 6D-2 each correspond to the step of forming the carbon-containing film 77 having sp3 bonds. Steps illustrated in FIGS. 6B-3, 6C-4, and 6D-4 each correspond to the step of forming the carbon-containing film 77 into the carbon-containing layer 47 having sp2 bonds.

Next, an embodiment in which a target 9 is used in a target unit 51 mounted as an anode into a radiation generating apparatus 101 shown in FIG. 3A is described with reference to FIGS. 4D and 4E.

Figure 4D:
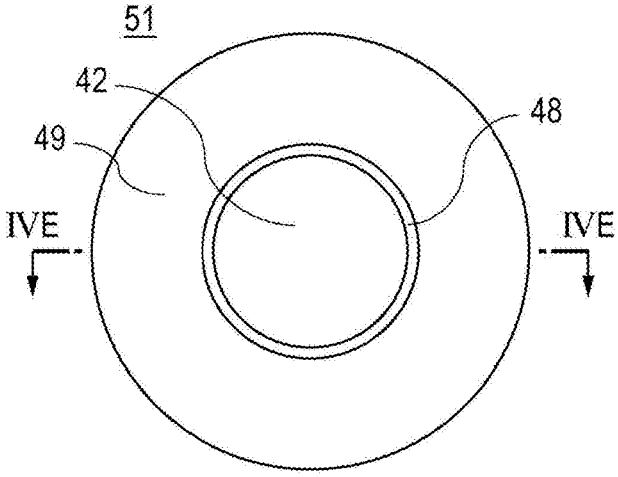

FIG. 4D shows a transmission type target unit 51 (hereinafter simply referred to as a target unit 51) equipped with the target 9 shown in FIG. 4A in a hollow portion of a cylindrical anode member 49. The inner peripheral portion of the hollow portion of the target unit 51 is connected to the outer peripheral portion of the target 9 via brazing 48. The brazing 48 may be an alloy having a low melting point such as an alloy containing tin, silver, or the like. In this embodiment, in the outer peripheral portion of the target 9, the periphery of the diamond substrate 41 overlaps the periphery of the target layer 42.

In the target unit 51, the brazing 48 serves as a bonding material that holds the target 9 and is responsible for establishing an electrical connection between the anode member 49 and the target layer 42.

Figure 4E:
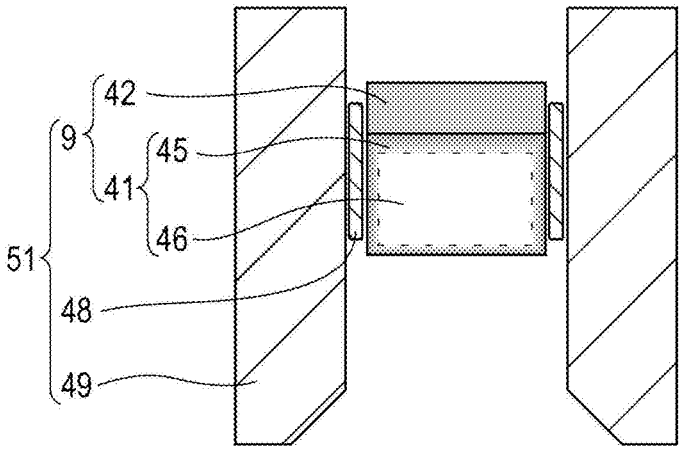

FIG. 4E is a cross-sectional view of the target unit 51 shown in the plan view of FIG. 4D taken along line IVE-IVE in FIG. 4D. According to the structure of this embodiment, the sp2 bonds exhibit electric conductivity and the reliability of the electrical connection between the target 9 and the anode member 49 is enhanced.

The anode member 49 is composed of a material having a large specific gravity. Thus the anode member 49 can define radiation output angle (radiation angle) in a required direction and can block the radiation from going out in undesirable directions as shown in FIG. 3A.

From the viewpoint of further size reduction, a metal element having a specific absorption edge energy may be appropriately selected as the material for forming the anode member 49 on the basis of a characteristic X-ray energy of the radiation generated from the target layer 42.

Specific examples of such a metal element for forming the anode member 49 include copper, silver, molybdenum, tantalum, tungsten, KOVAR (US registered trademark, Ni—Co—Fe alloy produced by CRS Holdings Inc.), MONEL (Ni—Cu—Fe alloy, US registered trademark co-owned by Special Metals Corporation and Huntington Alloys Corporation), and stainless steel. The same metal element as the target metal contained in the target layer 42 may also be contained in the anode member 49.

The scope of the invention disclosed in this specification also encompasses a multilayered target layer 42 formed of two or more layers and an embodiment in which the carbon-containing region has sp1 bonds (carbon-carbon triple bonds) as long as the effect brought by the carbon-containing region having sp2 bonds is obtained.

EXAMPLES

A radiation generating apparatus equipped with a target according to an embodiment of the invention was prepared by the procedure described below, and operated to evaluate output stability.

Example 1

Figure 2A:
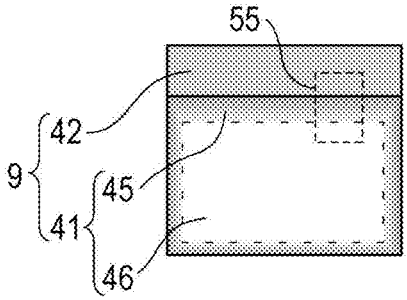
FIG. 2A and FIG. 2B are schematic cross-sectional views of a section specimen 55 in Example 1 and show the positional relationship between analyzed regions 145 and 146.
Figure 2B:
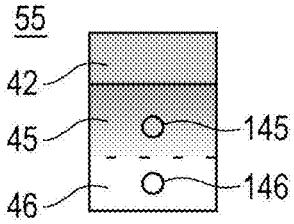
Figure 2C:
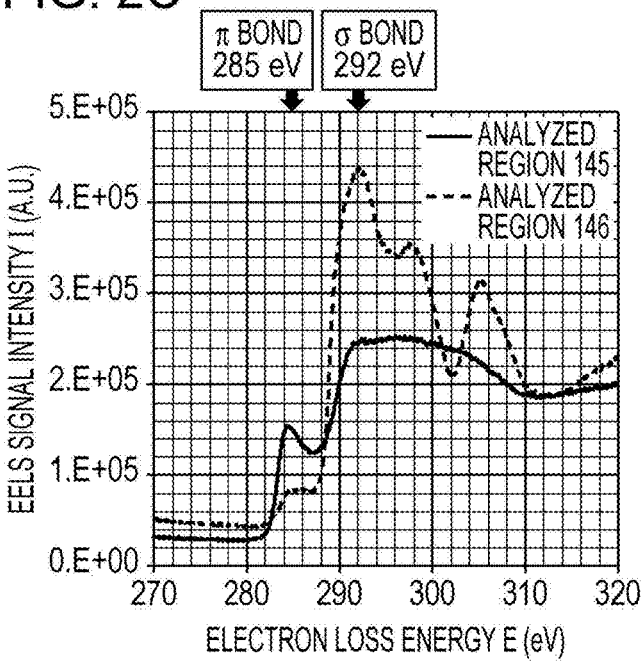
FIG. 2C shows a STEM-EELS profile.
Figure 2D:
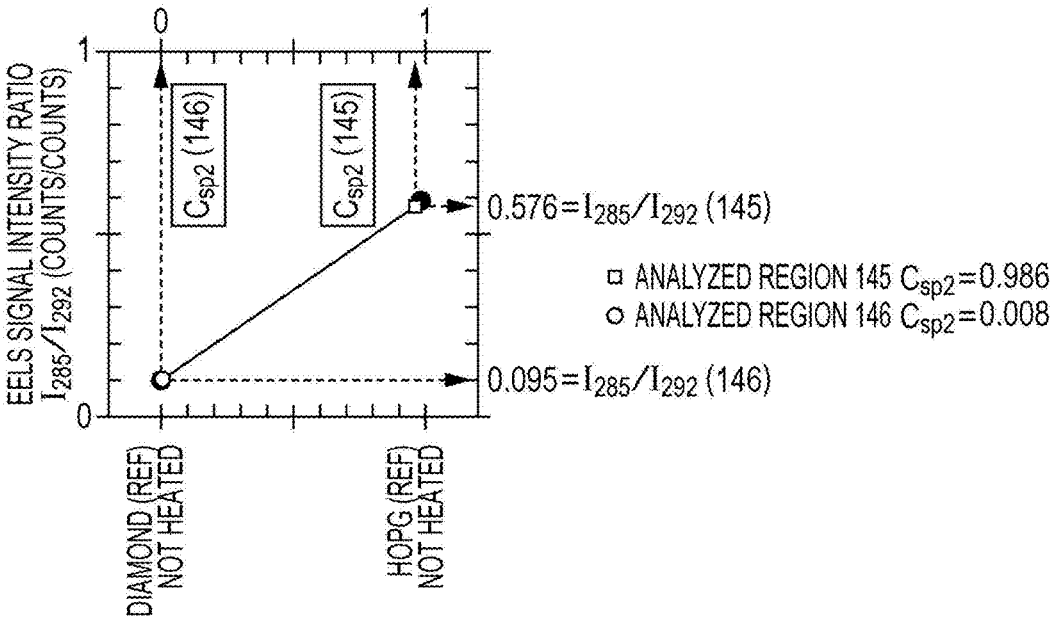
FIG. 2D is a calibration line data used in obtaining a normalized sp2 bond concentration.

FIG. 1A is a schematic diagram of a target 9 prepared in Example 1. The procedure of preparing the target 9 of Example 1 is shown in FIGS. 5B-1 to 5B-4. A section specimen 55 of the target 9 of this example is shown in FIG. 2A and analyzed regions 145 and 146 in the section specimen 55 are shown in FIG. 2B. FIG. 2C shows a profile of the results of electron energy loss spectroscopy. FIG. 2D shows a calibration graph used to identify the normalized sp2 bond concentration $C_{sp2}$.

Figure 7:
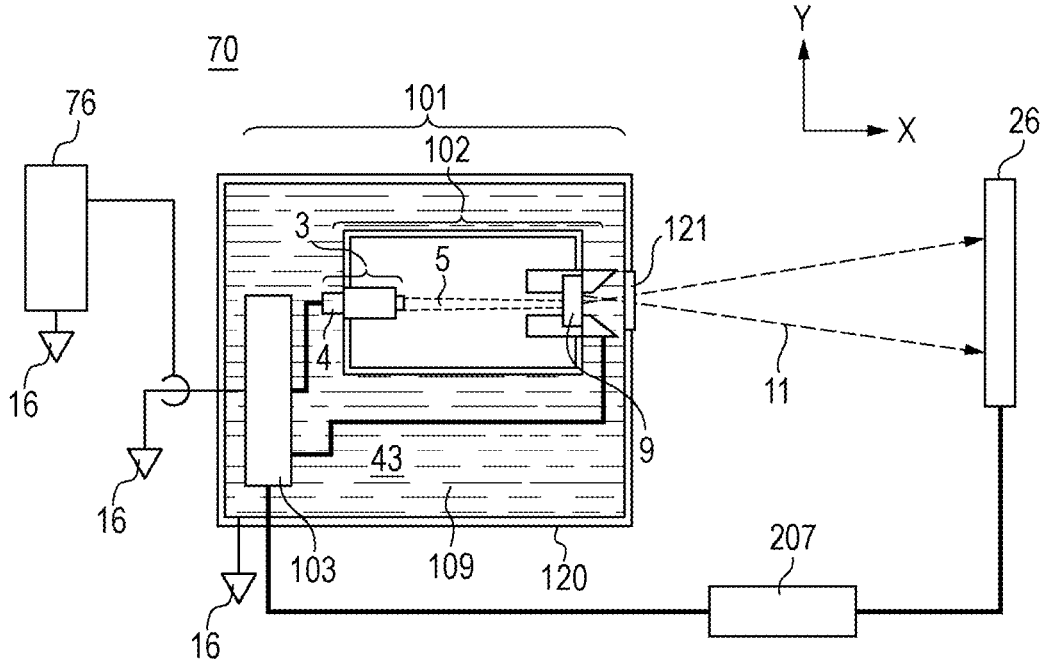
FIG. 7 is a schematic diagram of a system for evaluating stability of radiation output from a radiation generating apparatus of each Example.

FIG. 3A shows a schematic structure of a radiation generating tube 102 loaded with the target 9 of this example. FIG. 3B shows a radiation generating apparatus 101 loaded with the radiation generating tube 102. The evaluation system used to evaluate stability of radiation output of the radiation generating apparatus 101 of this example is shown in FIG. 7.

First, as shown in FIG. 5B-1, a diamond substrate 41 having a diameter of 6 mm and a thickness of 1 mm and composed of single crystal diamond was prepared. The diamond substrate 41 was cleaned with a UV ozone asking device to remove residual organic matter on the surfaces of the diamond substrate 41.

Next, as shown in FIG. 5B-2, a metal-containing layer 72 having a thickness of 5 μm and composed of tungsten was sputter-deposited on one of the clean surfaces of the diamond substrate 41 by using an argon gas as a carrier gas and a sintered tungsten target as a sputtering target.

Then a stack of the metal-containing layer 72 and the diamond substrate 41 was placed in an image furnace (not shown) by using a ceramic holder jig (not shown) composed of alumina. Then a vacuum atmosphere was created in the interior of the image furnace. The stack was irradiated with an infrared ray for 10 hours so that the temperature of the stack was 1300° C. so as to conduct a heating step. As a result, a target 9 of Example 1 was obtained.

The thickness of the target layer 42 of the target 9 came out to be 6 μm.

Visual observation of the target 9 of this example revealed that brown to black shaded regions were distributed mainly near the surfaces of the diamond substrate 41, as shown in FIG. 5B-3.

Next, as shown in FIG. 2A, a section specimen 55 was cut out from the target 9 by mechanical polishing and focused ion beam (FIB) processing. The section specimen 55 was taken to include a region that extended from the lower edge of the target layer 42 by 300 nm toward the target layer 42 side and a region that extended from the lower edge of the target layer 42 by 500 nm toward the diamond substrate side.

A region near the border between the target layer 42 and the diamond substrate in the section specimen 55 was observed with a scanning transmission electron microscope (STEM). From the image contrast, a region constituted by elements having a specific gravity smaller than that of the target layer 42 was found near the target layer 42 but within the diamond substrate 41. This region was assumed to be the carbon-containing region 45.

The assumed carbon-containing region 45 exhibited a halo pattern when measured with an electron beam diffractometer (STEM-ED) attached to STEM and no lattice fringes were observed in a high-resolution observation mode, thereby revealing that the carbon-containing region 45 was an amorphous phase. EDX analysis attached to STEM found that the carbon-containing region 45 is a region mainly composed of carbon.

In order to identify the carbon-containing region, which is a feature of the invention, STEM-EELS evaluation was performed by using an electron loss energy spectrometer attached to STEM.

FIG. 2C shows the EELS profile obtained by the STEM-EELS analysis. The horizontal axis indicates the electron loss energy and the vertical axis indicates the intensity I of an EELS signal. The signal intensity $I_{285}$ at an electron loss energy of 285 eV corresponds to the concentration of π bonds. The signal intensity $I_{292}$ at an electron loss energy of 292 eV corresponds to the concentration of σ bonds.

In EELS analysis, the sp2 bonds which are carbon-carbon double bonds are detected as the EELS signal at 285 eV and the EELS signal at 292 eV ($I_{285}$ and $I_{292}$) attributable to σ bonds and π bonds. The sp3 bonds which are carbon-carbon single bonds are detected as the EELS signal ($I_{292}$) at 292 eV attributable to σ bonds.

It can be qualitatively understood from the profile shown in FIG. 2C that in the analyzed region 145, the concentration of sp2 bonds constituted by π bonds and σ bonds is significantly high and, in the analyzed region 146, the concentration of sp3 bonds constituted by σ bonds is significantly high.

An EELS signal was observed at 285 eV in the analyzed region 146. However this EELS signal is presumably attributable to unavoidable hydrocarbons that had been physically adsorbed from the analytic atmosphere or polymeric carbon resulting from irradiation with the electron beam. In other words, it is assumed that the EELS signal detected at 285 eV possibly indicates real carbon bonds of the specimen superimposed with background signals irrelevant to the specimen.

In order to confirm the influence of the background signals, synthetic diamond not subjected to a heat treatment was analyzed as a reference specimen through EELS. The EELS signal having about the same intensity as that detected in the analyzed region 146 was detected at 285 eV. It was confirmed that background signals (noise component) inherent to the measurement system are dominant in the EELS signals detected at 285 eV from the analytical position 146 and the diamond reference specimen.

In general, the detection sensitivity differs for every characteristic energy of electron loss energy. In particular, depending on conditions inherent to the measurement system and conditions of measurement, π bond concentration/$I_{285}$ signal intensity (=π bond detection sensitivity) does not match σ bond concentration/$I_{292}$ signal intensity (=σ bond detection sensitivity). The EELS profile shown in FIG. 2C is raw data and at least affected by this.

In order to eliminate the influence of these errors related to identification of the sp2 bond concentration, the inventors of the present application performed correction as below so as to eliminate the influence of background signals and the dependency of the detection sensitivity on the characteristic energy so as to identify the value of sp2 bond concentration.

To be more specific, single crystal synthetic diamond not subjected to a heat treatment and single crystal graphite (highly ordered pyrolytic graphite or HOPG) not subjected to a heat treatment were used as the reference specimens and a calibration line shown in FIG. 2D was drawn by using the two reference specimens to eliminate the error caused by background signals.

The error attributable to the dependency of the detection sensitivity on characteristic energy was eliminated by using the EELS signal intensity ratio $I_{285}/I_{292}$, which is the ratio obtained by dividing the EELS signal intensity $I_{285}$ detected at 285 eV by the EELS signal intensity $I_{292}$ detected at 292 eV.

Then normalized sp2 bond concentration $C_{sp2}$ obtained by eliminating the aforementioned two types of errors was defined by using formula (1) shown below.

[Math. 1]

$$C_{sp2}(\text{sample}) = \frac{I285/I292(\text{sample}) - I285/I292(ref.diamond)}{I285/I292(ref.HOPG) - I285/I292(ref.diamond)} \quad \text{Formula (1)}$$

As a result, it was found that the normalized sp2 bond concentrations in the analyzed region 145 and the analyzed region 146 were 98.6% and 0.8%, respectively.

As discussed above, based on the results of the EELS analysis of the diamond substrate 41 of the target 9 of this example and other composition-structure analysis, the analyzed region 145 was identified to be composed of amorphous carbon mainly containing sp2 bonds and the analyzed region 146 was identified to be composed of diamond mainly composed of sp3 bonds.

The analyzed regions 145 and 146 were set so that they respectively lay in the assumed carbon-containing region 45 and the region 46 from which lattice fringes caused by crystallinity of diamond were observed in a high resolution observation mode as shown in FIG. 2B. STEM-EELS line analysis conducted in the thickness direction of the target layer 42 revealed that the assumed carbon-containing region 45 was distributed by having a thickness of 80 nm to 250 nm. The STEM-EELS line analysis was performed at 20 nm intervals and the detection intervals were appropriately decreased to several nanometers in the area near the border between the assumed carbon-containing region 45 and the other structure.

Next, a radiation generating tube 102 equipped with the target 9 prepared in Example 1 was produced by the following procedure. First, as shown in FIGS. 4D and 4E, the target 9 was brazed onto an anode member 49 composed of copper to form a target unit 51 that served as an anode. Then an electron emitting source 3 including an impregnated type electron gun equipped with an electron emitting portion 2 composed of lanthanum boride ($LaB_6$) was brazed onto a cathode member (not shown) composed of Kovar so as to prepare a cathode.

Then the cathode and the anode were respectively brazed onto two openings of an insulation tube 110 composed of alumina (FIG. 3A) so as to form an envelope. An inner space 13 of the envelope was evacuated with an evacuator (not shown) until a degree of vacuum of $1\times10^{-6}$ Pa was reached. As a result, a radiation generating tube 102 shown in FIG. 3A was produced.

A drive circuit 103 was electrically connected to the cathode and the anode of the radiation generating tube 102. The radiation generating tube 102 and the drive circuit 103 were housed in an extra space 43 of a container 120. As a result, a radiation generating apparatus 101 shown in FIG. 3B was obtained.

An evaluation system 70 shown in FIG. 7 was prepared to evaluate the drive stability of the radiation generating apparatus 101. In the evaluation system 70, a dosimeter 26 was placed in front of a radiation transmitting window 121 of the radiation generating apparatus 101 and disposed at a position 1 m from the radiation transmitting window 121. The dosimeter 26 was connected to the drive circuit 103 via a measurement control unit 207 and was capable of measuring the intensity of the output radiation from the radiation generating apparatus 101.

The drive conditions for evaluation of drive stability were as follows. The tube voltage of the radiation generating tube 102 was +100 kV, the current density of the electron beam irradiating the target layer 42 was 4 mA/mm$^2$, and pulsed drive of repeating an electron irradiation period of 2 seconds and a non-irradiation period of 198 seconds was performed. An average value of output intensity was determined from the intensities detected during 1 second at the middle of the electron irradiation period and the obtained average value was assumed to be the detected radiation output intensity.

The stability evaluation of the radiation output intensity was performed in terms of a retention rate determined by normalizing the radiation output intensity after elapse of 100 hours from the start of the radiation output by using the initial radiation output intensity.

In evaluating the stability of the radiation output intensity, the tube current flowing from the target layer 42 to a ground electrode 16 was measured and constant-current control was performed by using a negative feedback circuit (not shown) so that the fluctuation in the electron current density irradiating the target layer 42 was within 1%. During evaluation of drive stability of the radiation generating apparatus 101, a discharge counter 76 monitored that the radiation generating apparatus 101 was driven stably without causing discharge.

The retention rate of the radiation output of the radiation generating apparatus 101 of this example was 0.98. This confirmed that the radiation generating apparatus 101 equipped with the target 9 of this example does not show significant fluctuations in radiation output even after long hours of driving history and stable radiation output intensity is obtained. The radiation generating apparatus 101 of this example that underwent the test of evaluating stability of radiation output intensity was disassembled to take out the target unit 51. No microcrack were observed in the target layer 42 of the target unit 51.

Example 2

In Example 2, a radiation generating apparatus 101 was produced as in Example 1 except that the steps shown in FIGS. 5A-1 to 5A-3 were performed to prepare a target 9. The stability of radiation output of the radiation generating apparatus 101 was evaluated.

First, as in Example 1, surfaces of a diamond substrate 41 were washed as shown in FIG. 5A-1. Then as shown in FIG. 5A-2, the diamond substrate 41 was placed in an image furnace (not shown) by using a ceramic holder jig (not shown) composed of alumina. Then a vacuum atmosphere was created in the interior of the image furnace. The diamond substrate 41 was irradiated with an infrared ray for 10 hours so that the temperature of the diamond substrate 41 was 1500° C. so as to conduct a heating step.

Next, a target layer 42 composed of tungsten and having a thickness of 7 μm was sputter-deposited on one of the surfaces of the diamond substrate 41 that underwent the heat treatment as shown in FIG. 5A-3. As a result, a target 9 of Example 2 was obtained.

Visual observation of this example revealed that grown to black shaded regions were distributed mainly near the surfaces of the diamond substrate 41, as shown in FIG. 5A-3.

As in Example 1, a section specimen 55 was cut out from the target 9 of Example 2 by mechanical polishing and FIB processing. The section specimen 55 was taken to include a region that extended from the lower edge of the target layer 42 by 300 nm toward the target layer 42 side and a region that extended from the lower edge of the target layer 42 by 500 nm toward the diamond substrate side as shown in FIG. 2B.

A region near the border between the target layer 42 and the diamond substrate in the section specimen 55 was observed with a scanning transmission electron microscope (STEM). From the image contrast, a region constituted by elements having a specific gravity smaller than that of the target layer 42 was found near the target layer 42 but within the diamond substrate 41. This region was assumed to be a carbon-containing region 45. STEM-EELS line analysis of the target layer 42 was performed in the thickness direction and it was confirmed that the assumed carbon-containing region 45 was distributed by having a thickness of 100 nm to 210 nm.

Next, STEM-EELS evaluation was performed by using an electron loss energy spectrometer attached to STEM in order to identify the carbon-containing region featured in the present invention.

As a result, it was found that the normalized sp2 bond concentration was 95% in the detection region corresponding to the carbon-containing region and that the normalized sp2 bond concentration was 1% in the detection region corresponding to the diamond substrate 41.

A radiation generating tube 102 and a radiation generating apparatus 101 were produced as in Example 1 but by using the target 9 prepared in Example 2. The radiation generating apparatus 101 was loaded into the evaluation system 70 for measuring the drive stability shown in FIG. 7.

The radiation output retention rate of the radiation generating apparatus 101 of this example was 0.97. This confirmed that the radiation generating apparatus 101 equipped with the target 9 of this example does not show significant fluctuations in radiation output even after long hours of driving history and stable radiation output intensity is obtained. The radiation generating apparatus 101 of this example that underwent the test of evaluating stability of radiation output intensity was disassembled to take out the target unit 51. No microcrack were observed in the target layer 42 of the target unit 51.

Example 3

Figures 1, 5D:
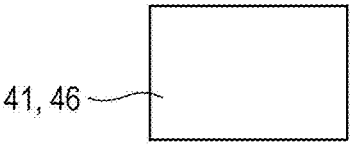
Figures 1, 5E:
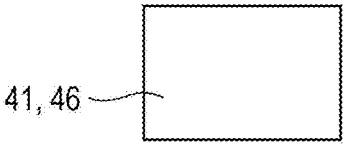
Figures 2, 5D:
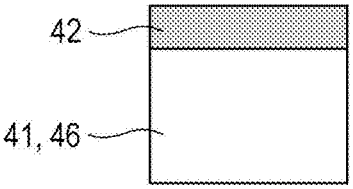
Figures 2, 5E:
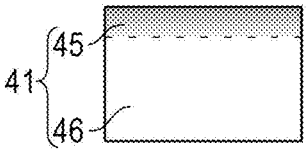
Figures 3, 5D:
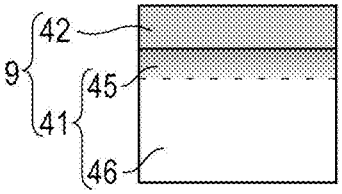
Figures 3, 5E:
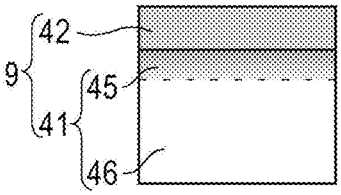

A radiation generating apparatus 101 was produced as in Example 1 except that the steps illustrated in FIGS. 5D-1 to 5D-3 were performed to prepare a target 9 in Example 3. The radiation output stability of the radiation generating apparatus 101 was evaluated.

First, as in Example 1, surfaces of a diamond substrate 41 were washed as shown in FIG. 5D-1. Then as shown in FIG. 5D-2, a target layer 42 composed of tungsten and having a thickness of 7 μm was sputter-deposited on one of the surfaces of the diamond substrate 41 so as to form a stack.

Next, the stack was placed in a chamber (not shown) and the interior of the chamber was purged with nitrogen gas. The stack's surface on which the target layer 42 was formed was irradiated with an infrared ray having a wavelength of 808 nm via a quartz window of the chamber by using a semiconductor laser beam source. Irradiation with the laser beam was performed 1000 times by pulsed driving using a Q switch. As a result, a target 9 in which a portion of the diamond substrate 41 near the interface with the target layer 42 turned brown to black in color was obtained as shown in FIG. 5D-3.

As shown in FIG. 2A, a section specimen 55 was cut out from the target 9 of Example 3 by mechanical polishing and FIB processing. The section specimen 55 was taken to include a region that extended from the lower edge of the target layer 42 by 300 nm toward the target layer 42 side and a region that extended from the lower edge of the target layer 42 by 500 nm toward the diamond substrate side.

A region near the border between the target layer 42 and the diamond substrate in the section specimen 55 was observed with a scanning transmission electron microscope (STEM). From the image contrast, a region constituted by elements having a specific gravity smaller than that of the target layer 42 was found near the target layer 42 but within the diamond substrate 41. This region was assumed to be a carbon-containing region 45. STEM-EELS line analysis of the target layer 42 was performed in the thickness direction and it was confirmed that the assumed carbon-containing region 45 was distributed by having a thickness of 55 nm to 120 nm.

Next, STEM-EELS evaluation was performed by using an electron loss energy spectrometer attached to STEM in order to identify the carbon-containing region featured in the present invention.

As a result, it was found that the normalized sp2 bond concentration was 96% in the detection region corresponding to the carbon-containing region and that the normalized sp2 bond concentration was 1% in the detection region corresponding to the diamond substrate 41.

A radiation generating tube 102 and a radiation generating apparatus 101 were produced as in Example 1 but by using the target 9 prepared in Example 3. The radiation generating apparatus 101 was loaded into the evaluation system 70 for measuring the drive stability shown in FIG. 7.

The radiation output retention rate of the radiation generating apparatus 101 of this example was 0.98. This confirmed that the radiation generating apparatus 101 equipped with the target 9 of this example does not show significant fluctuations in radiation output even after long hours of driving history and stable radiation output intensity is obtained. The radiation generating apparatus 101 of this example that underwent the test of evaluating stability of radiation output intensity was disassembled to take out the target unit 51. No microcrack were observed in the target layer 42 of the target unit 51.

Example 4

A radiation generating apparatus 101 was produced as in Example 1 except that the steps illustrated in FIGS. 6B-1 to 6B-4 were performed to prepare a target 9 of Example 4. The radiation output stability of the radiation generating apparatus 101 was evaluated.

First, as in Example 1, surfaces of a diamond substrate 41 were washed as shown in FIG. 6B-1. Then as shown in FIG. 6B-2, a carbon-containing film 77 composed of diamond-like carbon and having a thickness of 100 nm was formed by a CVD device on one of the surfaces of the diamond substrate 41 so as to form a stack.

Next, the stack was placed in an image furnace (not shown) by using a ceramic holder jig (not shown) composed of alumina. Then a vacuum atmosphere was created in the interior of the image furnace. The stack was irradiated with an infrared ray for 10 hours so that the temperature of the stack was 1400° C. so as to conduct a heating step. As a result, the carbon-containing film 11 was transformed into a carbon-containing layer 47 including a sp2 bond. Next, as shown in FIG. 6B-4, a target layer 42 composed of tungsten and having a thickness of 6 μm was sputter-deposited on the carbon-containing layer 47. As a result, a target 9 of Example 4 was obtained.

As in Example 1, a section specimen 55 was cut out from the target 9 of Example 4 by mechanical polishing and FIB processing. The section specimen 55 was taken to include a region that extended from the lower edge of the target layer 42 by 300 nm toward the target layer 42 side and a region that extended from the lower edge of the target layer 42 by 500 nm toward the diamond substrate side as shown in FIG. 2B.

A region near the border between the target layer 42 and the diamond substrate in the section specimen 55 was observed with a scanning transmission electron microscope (STEM). As a result, formation of a carbon-containing layer 47 constituted by elements having a smaller specific gravity than the target layer 42 was confirmed between the target layer 42 and the diamond substrate 41. STEM-EELS line analysis of the target layer 42 was performed in the thickness direction and it was confirmed that the carbon-containing layer 47 was distributed by having a thickness of 65 nm to 95 nm.

Next, STEM-EELS evaluation was performed by using an electron loss energy spectrometer attached to STEM in order to identify the carbon-containing region featured in the present invention.

As a result, it was found that the normalized sp2 bond concentration was 97% in the detection region corresponding to the carbon-containing region and that the normalized sp2 bond concentration was 1% in the detection region corresponding to the diamond substrate.

A radiation generating tube 102 and a radiation generating apparatus 101 were produced as in Example 1 but by using the target 9 prepared in Example 4. The radiation generating apparatus 101 was loaded into the evaluation system 70 for measuring the drive stability shown in FIG. 7.

The radiation output retention rate of the radiation generating apparatus 101 of this example was 0.96. This confirmed that the radiation generating apparatus 101 equipped with the target 9 of this example does not show significant fluctuations in radiation output even after long hours of driving history and stable radiation output intensity is obtained. The radiation generating apparatus 101 of this example that underwent the test of evaluating stability of radiation output intensity was disassembled to take out the target unit 51. No microcrack were observed in the target layer 42 of the target unit 51.

Example 5

Figure 3C:
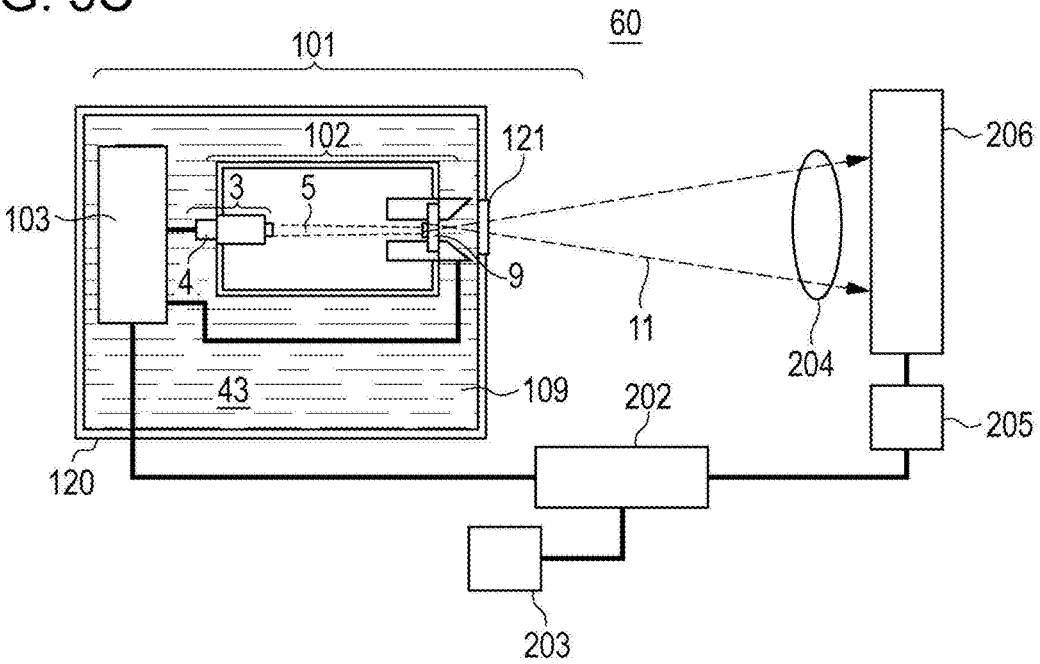
FIG. 3C is a schematic diagram that shows a radiography system.

In Example 5, the radiation generating apparatus 101 prepared in Example 1 was used to produce a radiography system 60 shown in FIG. 3C.

An X-ray image having a high S/N ratio was obtained from the imaging apparatus 60 of Example 5 since the radiation generating apparatus 101 in which fluctuation of radiation output was suppressed was used therein.

It should be noted here that in Examples 1 to 3, identification of the carbon-containing region and identification of the normalized sp2 concentration were performed by EELS. However, the identification technique is not limited to EELS and any other analysis technique such as Raman spectrometry or X-ray photoelectron spectrometry capable of separating carbon-carbon bonds can be employed.

According to the present invention, it becomes possible to provide a highly reliable transmission type target with which stress occurring at the interface between a diamond substrate and a target layer is relaxed and generation of microcracks is suppressed even when the target is operated at high temperature.

Furthermore, it becomes possible to assuredly provide an anode potential to the target layer even when operation at high temperature is conducted and thus a highly reliable radiation generating tube with which radiation output fluctuations are suppressed can be obtained. Moreover, a radiation generating apparatus and a radiography system each having a highly reliable radiation emission tube can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-049350, filed Mar. 12, 2013 which is hereby incorporated by reference herein in its entirety.

What is claimed is:

1. A method for producing a transmission type target, the method comprising:

a target layer formation step of forming a target layer configured to generate an X-ray upon irradiation with electrons; and a sp2 bond formation step of forming a carbon-containing region comprising sp2 bonds in a diamond substrate, wherein the carbon-containing region is formed from a part of diamond in the diamond substrate, wherein the carbon-containing region is between the target layer and regions of the diamond substrate that are not the carbon-containing region, wherein the target layer formation step includes a step of forming a metal layer on one surface of the diamond substrate, the metal layer comprising a target metal, and the sp2 bond formation step includes a heating step of heating at least the diamond substrate so as to convert at least some of sp3 bonds contained in the surface of the diamond substrate into sp2 bonds, and wherein the heating step is performed before the step of forming a metal layer.

2. The method according to claim 1, wherein the heating step is performed under a vacuum environment or an inert gas atmosphere.

3. The method according to claim 1, wherein the heating step is performed at a temperature of 650° C. or higher and 2000° C. or lower.

4. The method according to claim 1, wherein the sp2 bond formation step is performed by forming a carbon-containing layer comprising sp2 bonds on one surface of the diamond substrate.

* * * * *